United States Patent [19]

Kobayashi

[11] 4,296,882

[45] Oct. 27, 1981

[54] CENTRIFUGAL FLUID PROCESSING DEVICE

[75] Inventor: Susumu Kobayashi, Fujinomiya, Japan

[73] Assignee: Terumo Corporation, Tokyo, Japan

[21] Appl. No.: 122,188

[22] Filed: Feb. 19, 1980

[30] Foreign Application Priority Data

Feb. 26, 1979 [JP] Japan ..... 54-21716

[51] Int. Cl.[3] ..... B04B 11/00; B04B 9/08

[52] U.S. Cl. ..... 233/21; 233/1 E; 233/25; 366/219

[58] Field of Search ..... 233/25, 23 A, 23 R, 233/26, 24, 3, 21, 1 E; 210/78, 84, 210, 211, 325; 366/287, 219

[56] References Cited

U.S. PATENT DOCUMENTS

| | | | |
|---|---|---|---|
| 697,255 | 4/1902 | Kaczorwski | 210/325 |
| 3,609,921 | 10/1971 | Foster | 233/25 |
| 3,850,368 | 11/1974 | Boeckeler | 233/25 |
| 4,082,217 | 4/1978 | Westberg | 233/25 |
| 4,134,445 | 1/1979 | Goodrich | 233/26 |

*Primary Examiner*—Robert W. Jenkins
*Attorney, Agent, or Firm*—Frishauf, Holtz, Goodman and Woodward

[57] ABSTRACT

A centrifugal separator for fluids, e.g. blood, comprised of components or ingredients having different specific gravities, in which a container is mounted on a rotor rotatable about the vertical axis thereof and being rotatable about its horizontal axis independently of the rotor and, as the rotor is rotated, the container revolves about the vertical axis of the rotor and also rotates about its own horizontal axis simultaneously, so that a resultant centrifugal force of vertical and horizontal centrifugal forces acts on a liquid contained in a bag or bottle installed in the container. A flexible fluid communication conduit has its one end connected to the bag in the container, and it extends along the horizontal axis to a chamber defined by the rotor, where it is bent so as to then extend along the vertical axis. Thus, the conduit can guide the fluid flow without being completely twisted by the rotating rotor and the container revolving and rotating therewith.

16 Claims, 10 Drawing Figures

CENTRIFUGAL FLUID PROCESSING DEVICE

BACKGROUND OF THE INVENTION

The present invention relates generally to the centrifugalization of fluids and, more specifically, to such a centrifugalization of blood or the like biological fluids in a closed system.

Heretofore, the following three processes have been generally used to centrifugalize, for example, blood into an erythrocytic, leukocytic, thrombocytic and plasmic fractions or to separate thrombocytes out of a mixture solution prepared, for a cleaning purpose, by mixing thawed lyophilized erythrocytes with a cleaning solution containing a cryophylactic agent:

(1) A bag containing the blood to be processed is set on a centrifugal separator, and the separator is operated for a sufficient time for separation. Then, centrifugalized fractions are taken out, in order from a fraction having the smallest specific gravity to one having the largest specific gravity, from a soft tubular section of the removed bag by manually compressing the same.

(2) The blood to be processed is fed into a frustoconical hollow container, to which conduits for feeding the blood and discharging the separated fractions are connected through rotary seals at its upper part. The blood fed into the container is centrifugalized into, for example a hematocytic fraction and plasmic fraction, and only the separated plasmic fraction, for example, is taken out through the discharge conduit, while the remaining hematocytic fraction is removed by stopping the operation of the centrifuge when the container is filled up with the hematocytic fraction.

(3) Blood to be processed is fed into a centrifugalizing container placed in a rotor of a centrifugal separator through one feed and discharge conduit which extends first downwardly from the central part of the rotor and then extends upwardly outside the rotor to be led to the outside of the centrifugal separator from a predetermined position above the rotor. The blood is centrifugalized by the rotation of the container and the separated fractions are taken out through the same conduit. This type of centrifugal separator may be used also for so-called blood cleaning by feeding a cleaning solution through the conduit into the centrifugalizing container.

These blood processing methods have been proposed for maximizing the quantity of an intended blood component fraction that can be gathered from one donor, since recently blood-component or fractional-blood transfusions have become increasingly generalized.

However, the foregoing method (1) is inefficient and time-consuming in that it is a batch processing method in nature, in which the centrifugal separator is operated intermittently and an additional operation is then carried out for transferring the separated fluids to other containers.

In the foregoing method (2), since the blood is continuously fed into the centrifugal separator and centrifugalized therein while discharging the unintended plasmic fraction, the intended erythrocytic fraction can be gathered in a larger quantity in one processing. However, this method is also hardly free from the afore-mentioned drawbacks of the method (1), because the quantity of the erythrocytic fraction that can be gathered by one processing are limited by the container capacity and because the centrifugal separator is also operated intermittently.

Also, since rotary seals are used in this method, the blood may be contaminated with bacteria intruding therefrom or abrasion particulates originating therefrom may be included in the blood, and such rotary seals requiring high sealing properties are costly. Further, in view of the construction of the centrifugal separator used in this method, it is not possible to process a plurality of fluids simultaneously.

In the foregoing method (3), although the centrifugal separator is operated continuously, the processing requires a longer time because the feeding of the blood and cleaning solution and the discharge of separated fractions are effected in order through a single common conduit. Also, since the conduit revolves outside the rotor along with its rotation, the centrifugal separator must be larger in size than those for the foregoing methods (1) and (2) to apply to the fluid in the container a centrifugal force almost equal to those applied in the methods (1) and (2). Thus, its construction becomes complicated and susceptible to problems. Further, since a long conduit is used in this method, a larger quantity of fluid remains therein after processing. Besides, since the conduit revolves about and outside the container along with its rotation, a large centrifugal force acts for a longer period on the fluid flowing through the conduit. Thus, the fluid may be separated undesirably in the conduit.

A typical prior art example of the foregoing method (3) and equipment therefor is disclosed in U.S. Pat. No. 4,133,173. In U.S. Pat. No. 4,133,173, however, since a conduit extends upwardly outside the rotor from the underside thereof, it is difficult to shorten the conduit. Also, in this prior art apparatus, the conduit revolves along with the rotor rotation and, thus, a substantial centrifugal force acts on the vertical section of the conduit because a long arm of action extends from the vertical axis of the rotor assembly. Thus, since such a large centrifugal force is applied to the fluid flowing through the vertical section of the conduit, the centrifugalization in the container installed in the rotor assembly may be adversely affected thereby.

In the aforecited U.S. Patent, the problem of twisting the conduit by the rotation of the rotor assembly is solved by setting the speed ratio of the rotor assembly versus a rotor drive assembly to 2:1.

SUMMARY OF THE INVENTION

An object of the present invention is to provide a method of centrifugalization free from the aforementioned drawbacks of the prior art methods and equipment, in which blood and other fluids can be centrifugalized continuously and rapidly in a closed system without using rotary seals, and to provide a small-sized centrifugal fluid separator of a simplified construction and which can be fabricated at low cost.

In order to achieve the foregoing object, the arrangement according to the present invention is devised so that a resultant centrifugal force of a vertical and horizontal centrifugal forces acts on a fluid to be processed in a processing container means. Also, according to the present invention, a conduit passing the fluid extends into and through a rotor along the vertical axis thereof, where it is bent horizontally so as to extent towards and into the container means along the horizontal axis thereof. Thus, substantially no centrifugal force acts on the fluid flowing in the vertical direction, while a resultant centrifugal force acts on the fluid only when it flows in the horizontal direction, thereby achieving an efficient and rapid centrifugalization.

Accordingly, in the centrifugal fluid separator of the present invention, the outer fluid container is mounted on a rotor which is rotatable about its vertical axis so as to revolve along with the rotor about its vertical axis and to be rotatable about the horizontal axis of the container means independently of the rotor. The container means is coupled to a rotor driving means through, for example, a bevel gear mechanism.

Further, according to the present invention, a flexible communication conduit having one end thereof connected to the fluid processing container means and extending along the horizontal axis thereof to the inside of the rotor, where it is bent vertically to extend along the vertical axis of the rotor to be finally led out of the separator device at its other end.

In this arrangement according to the present invention, since substantially no desirably centrifugal force acts on the fluid flowing through the vertical section of the conduit and since the vertical section of the conduit does not run outside but runs inside the rotor, the conduit can be shortened so that the fluid is rapidly fed into the container means and the quantity of the fluid remaining in the conduit after processing is minimized.

Here, the problem of twisting the conduit by the rotor rotation must be considered. According to the present invention, this problem is solved in the following manner. That is to say, the speed of rotation of the container means about its horizontal axis is made substantially equal to that of the rotor about the vertical axis thereof and, further, as viewed from the direction in which the fluid flows through the conduit, the rotor is rotated about the vertical axis thereof in a given direction opposite to that in which the container means is rotated about the horizontal axis thereof. This arrangement is effective to prevent a complete twisting from being applied onto the conduit, especially, onto its curved section disposed in the rotor between its vertical section and horizontal section.

As described herein above, since the vertical section of the conduit does not rotate, it can be readily connected to an external fluid source without otherwise providing any special conduit-holding means.

Further, according to the present invention, the fluid can be continuously centrifugalized by using one or more tubes out of a plurality of tubes passed through the conduit exclusively as an inlet tube or tubes and the remaining tubes exclusively as outlet tubes. Thus, the processing throughput can be increased and the operating ease can be improved much over the prior art batch processing systems.

Furthermore, according to the present invention, since the aforementioned resultant centrifugal force acts on the fluid being centrifugalized, the length of the processing bag can be shortened and the centrifugal separator can be smaller in size as compared with the prior art centrifugal separators in which the fluid is subjected to centrifugalization only in the radial direction of the rotor.

The fluids that can be centrifugalized according to the present invention include: blood comprised of components having different specific densities such as erythrocytes, leukocytes, thrombocytes, etc.; biological or physiological fluids containing suspended erythrocytes in a state of thawed lyophilized erythrocytes; and urine or other liquids containing dispersed particulates, regardless of liquid or solid, having different specific gravities.

Hereinafter, how centrifugal forces act on the fluids to be processed in the centrifugalization according to the present invention will be described in a general manner with reference to FIGS. 1, 2*a* and 2*b*.

In the fluid centrifugalization process according to the present invention applied on the fluid fed into the container functioning as a fluid processing means is the resultant centrifugal force $F_c$ of the first centrifugal force $F_A$ produced by the movement of the container in a circular orbit around the rotor, namely container revolution about the vertical rotor axis, and the second centrifugal force $F_B$ produced by the rotation of the container itself about its horizontal axis. Thus, since the resultant centrifugal force $F_c$ acting on the fluid in the container works to increase the ultimate separation velocity of the fluid as compared with a case where only the gravity and the first centrifugal force act thereon, the time required for centrifugalization can be shortened and the centrifugal separator can be made smaller in size.

That is to say, representing the density of substantially spherical particle of a fluid component or fraction of the fed fluid as $\rho_s$, the particle diameter as D, the density of a gas or liquid fraction functioning as a solvent of the fed fluid as $\rho_f$, the viscosity thereof as $\mu$ and the acceleration of gravity as g, the ultimate separation speed U of the particles, namely the velocity given to the particles when they are separated out of the fluid under the gravitational action can be generally expressed by the following equations depending on the specific Reynolds number of the fluid:

$$\text{At } Re < 2: \quad U = g(\rho_s - \rho_f)D^2/18\mu \tag{1}$$

$$2 < Re < 500 \quad U = \left\{ \frac{4}{225} \cdot \frac{(\rho_s - \rho_f)^2 g^2}{\mu \rho_f} \right\}^{\frac{1}{3}} D \tag{2}$$

$$500 < Re < 10^5 \quad U = \sqrt{3g(\rho_s - \rho_f)D/\rho_f} \tag{3}$$

While, for a circular motion of a mass point having a mass m at a radius of gyration r and angular velocity $\omega$, the centrifugal force acting thereon is given by the following equation:

$$F = mr\omega^2/g_c \tag{4}$$

Where $g_c$ denotes a conversion factor in [kg·m/Kg·sec$^2$] to be used when Kg and kg are used in combination in numerical expressions.

As shown in FIG. 1, an equilibrium condition between the centrifugal force and pressure exerted on an infinitesimal cubage element (r·d$\theta$·dr·dz) in a revolving fluid of density $\rho_f$, can be expressed by the following equation:

$$r \cdot d\theta \cdot dz \cdot P + r \cdot d\theta \cdot dr \cdot dz \cdot \rho_f \cdot r \cdot \omega^2/g_c + (P + dP/2) \cdot dr \cdot d\theta \cdot dz = (r + dr) d\theta \cdot dz (P + dP) \tag{5}$$

By eliminating high-order differential terms, equation (5) can be abbreviated as follows:

$$dP \cdot g_c = \rho_f \cdot \omega^2 \cdot r \cdot dr \tag{6}$$

Assuming here that the foregoing infinitesimal cubage element is substituted by a solid particle of density $\rho_s$, the force F acting on that particle will be given by the following equation:

$$F = r \cdot d\theta \cdot dr \cdot dz \cdot \rho_s \cdot r \cdot \omega^2 / g_c - dP \cdot r \cdot d\theta \cdot dz \quad (7)$$

Since the particle cubage $V_P = r \cdot d\theta \cdot dr \cdot dz$, the foregoing equation (7) can be transformed into the following equation by substituting the equation (6) for dP in the equation (7):

$$F \cdot g_c = V_P(\rho_5 - \rho_f) r \cdot \omega^2 \quad (8)$$

When the particle is present in the fluid, the gravity exerts on the particle a separating force $F_1$ given by the following equation:

$$F_1 \cdot g_c = V_P(\rho_s - \rho_f) g \quad (9)$$

Thus, the centrifugalizing effect (Zc) can be expressed as follows:

$$Zc = F/F_1 = r \cdot \omega^2 / g \quad (10)$$

Therefore, the final separation velocity Ut under the centrifugal force can be expressed as follows by substituting $r \cdot \omega^2$ for g in the foregoing equations (1) and (3):

$$\text{At } Re < 2 \qquad Ut = r \cdot \omega^2 (\rho_s - \rho_f) D^2 / 18\mu \quad (11)$$

$$2 < Re < 500 \qquad Ut = \left\{ \frac{4}{225} \cdot \frac{(\rho_s - \rho_f)^2 (r \cdot \omega^2)^2}{\mu \rho_f} \right\}^{\frac{1}{3}} D \quad (12)$$

$$500 < Re < 10^5 \qquad Ut \simeq \sqrt{3r \cdot \omega^2 (\rho_s - \rho_f) D / \rho_f} \quad (13)$$

In this context, if blood is used as the fluid to be processed, since hematocytes corresponding to the aforesaid particle are fine in size to show a Reynolds number smaller than 2, the foregoing equation (11) applies.

Referring now to FIGS. 2*a* and 2*b*, a particle at a point spaced apart by a radius $r_A$ of a circular orbit from its vertical axis Y—Y and by radius $r_B$ from the axis of rotation of the outer container undergoes revolutions in two directions (at angular velocities $\omega_A$ and $\omega_B$). Thus, the centrifugal forces $F_A$ and $F_B$ produced by these revolutions can be expressed as $F_A = m r_A \omega_A^2 / g_c$ and $F_B = m r_B \omega_B^2 / g_c$, respectively. Here, since the speed ratio of the outer container and rotor is 1:1, $\omega_A = \omega_B$. By letting $C = m\omega_A^2 / g_c$, the resultant centrifugal force $F_c$ acting on the particle in a radial plane perpendicular to the vertical axis Y—Y of the circular orbit as shown in FIG. 2*a* can be expressed as follows:

$$F_c = \sqrt{\left(F_A \sqrt{r_A^2 - r_B^2} / r_A\right)^2 + (F_B + F_A \cdot r_B / r_A)^2} = C\sqrt{r_A^2 + 3r_B^2} = m\sqrt{r_A^2 + 3r_B^2} \cdot \omega_A^2 / g_c \quad (14)$$

While, the ultimate separation velocity Uc given to the particle in the fluid when it is separated therefrom can be expressed as follows:

$$U_c = \sqrt{r_A^2 + 3r_B^2} \cdot \omega_A^2 (\rho_s - \rho_f) D^2 / 18\mu \quad (15)$$

Thus, the ultimate separation velocity Uc is greater by a value corresponding to $\sqrt{r_A^2 + 3r_B^2} / r_A$ than the foregoing ultimate velocity $U_A$ produced only by the centrifugal force $F_A$ caused by the particle motion in the circular orbit around the vertical axis Y—Y.

Also, as shown in FIG. 2*b*, the resultant centrifugal force acting on the particle in a vertical plane containing the vertical axis Y—Y of the circular orbit is proportional to $\sqrt{r_A^2 + r_B^2}$. Thus, the ultimate separation velocity $U_c$ is greater than $U_A$ by a value corresponding to $\sqrt{r_A^2 + r_B^2} / r_A$.

Further, since $\rho_s$, $\rho_f$, D and $\mu$ are constant and $\omega_A$ is fixed, the ultimate separation velocity $U_c$ can be expressed as a function of $r_A$ and $r_B$ and is proportional to the difference between $\rho_s$ and $\rho_f$.

Therefore, the ultimate separation velocity of an intended fluid fraction can be determined by setting the radii $r_A$ and $r_B$ of the container revolution and rotation and angular velocity, as desired.

Also, the foregoing equations (12) and (13) can be expressed in terms of radius ratio.

In the discharge process of the centrifugalized fluid fractions according to the present invention, tube or tubes in the conduit used as outlet tube or tubes are sucked by a separated fraction gathering circuit connected thereto, and the separated fractions are discharged by flowing in the direction opposite to the flow direction of the feed fluid.

Although the same centrifugal forces as those acting on the feed fluid in the feed process are also exerted on the discharge flow in the discharge process, the discharge fluids do not undergo a further separation because the separated fluid fractions comprise substantially a single component, respectively, unlike the feed fluid which is a so-called composite fluid.

Hereinafter, the present invention will be described in detail by way of the preferred embodiments thereof with reference to the accompanying drawings, particularly, to FIGS. 3 through 9.

DETAILED DESCRIPTION OF THE PREFERRED EMBODIMENTS

Figure 3:
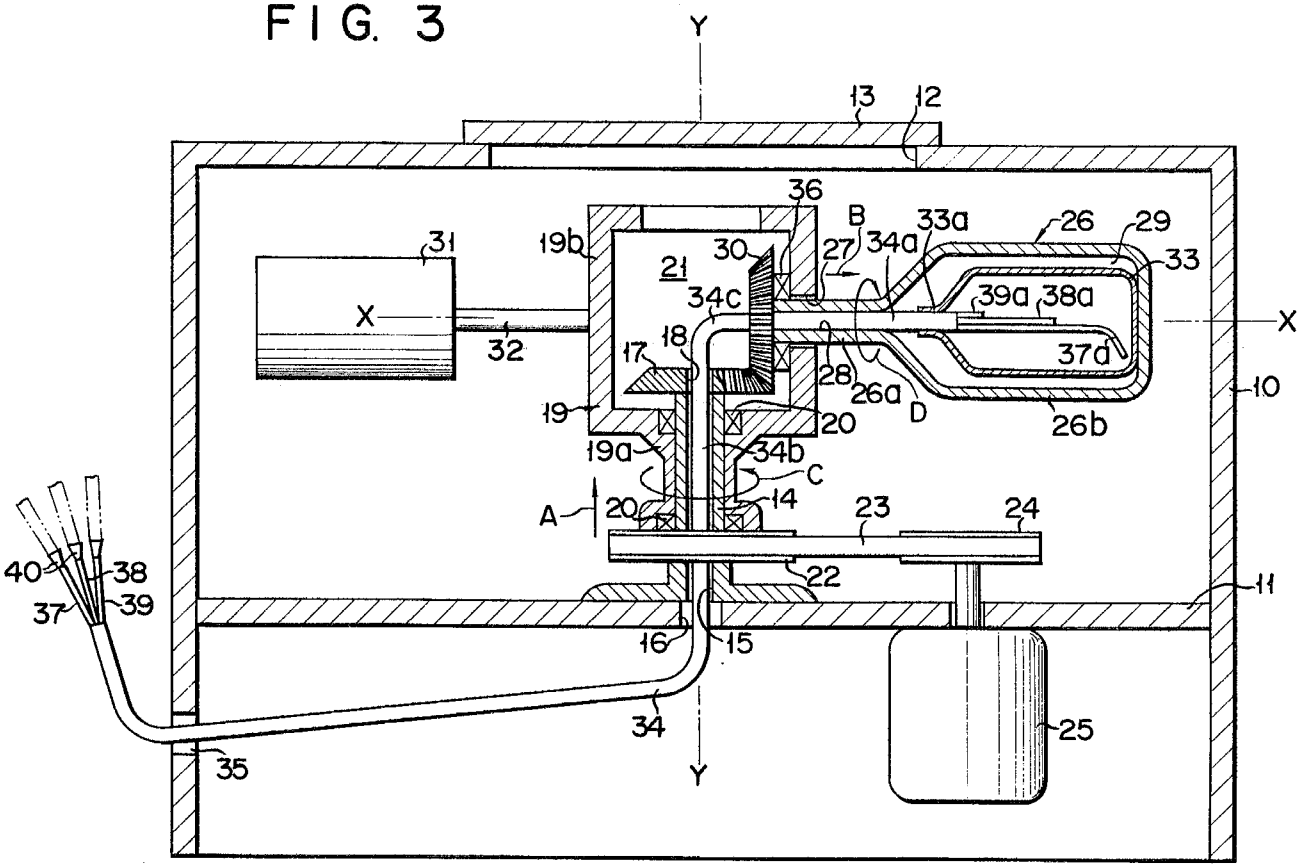
FIG. 3 is a longitudinal section of the first preferred embodiment of the centrifugal fluid processing device according to the present invention.

Referring now to the drawings, particularly, to FIG. 3 showing the first preferred embodiment of the centrifugal fluid processing device according to the present invention, the device has a housing 10 and base plate 11 horizontally stretched inside the housing 10. The housing 10 and the base plate 11 constitute a stationary base of the centrifugal fluid processing device. The housing 10 has, in its ceiling plate, an opening 12 which is opened and closed by a cover plate 13 placed thereover.

A supporting shaft 14 is fastened to the upper surface of the base plate 11 at its center and extends in the vertical direction upwardly therefrom. The supporting shaft 14 has a central axially extending hole for passing a conduit, and the hole 15 is communicated at its lower end with a hole 16 bored in the base plate 11. While, the upper end of the central axially extending hole 15 is communicated with an axial hole 18 bored in a first bevel gear 17. The first bevel gear 17 is fixed in a horizontal plane to the upper end of the stationary supporting shaft 14.

A rotor 19 comprises a lower shaft portion 19*a* and an upper enlarged portion 19*b*, and the shaft portion 19*a* is supported on the stationary supporting shaft via bearings 20, 20 freely rotatably about the vertical axis Y—Y. The enlarged portion 19*b* of the rotor defines inside thereof a chamber 21, into which the upper end portion of the stationary supporting shaft 14 extends from below and in which the aforesaid bevel gear 17 fixed to the upper end of the stationary supporting shaft 14 is disposed.

To the lower end of the shaft portion 19*a*, if fixed a driving pulley 22 which is linked to a motor pulley 24 by means of an endless V-belt 23. The motor pulley 24 is coupled through a motor shaft to an electric drive motor 25 mounted on the base plate 11. Thus, these pulleys 22 and 24, belt 23 and motor 25 form a rotary driving mechanism for the rotor 19. It is to be noted that in designing the device of the present invention, the rotary driving mechanism may be readily substituted with a gear drive or the like driving mechanism (which is not shown).

A fluid processing outer container 26 has a shaft portion 26*a* and an enlarged portion 26*b* which is formed integrally with the shaft portion 26*a*. The shaft portion 26*a* is inserted into a hole 27 bored in the side wall of the rotor 19, and is supported thereon by means of a bearing 36 rotatably independently of the rotor 19 around an axis which is radially disposed to the vertical axis Y—Y, namely, a horizontal axis X—X. Also, the shaft portion 26*a* has therein a central axially extending hole 28 for passing the conduit, and the hole 28 has its one end communicated with a container chamber 29 of the enlarged portion 26*b*.

It will be understood that, since the outer container 26 is mounted onto the rotor 19, the outer container 26 turns around the vertical axis Y—Y and a centrifugal force is exerted radially or horizontally thereon as the rotor 19 is rotated around the vertical axis Y—Y.

The other end of the shaft section 26*a*, namely its left-most end as seen in FIG. 3, extends into the chamber 21 defined by the rotor 19, where a second bevel gear 30 disposed in a vertical plane is fixed to said other end of the shaft portion 26*a* in constant mesh with the aforementioned first bevel gear 17. The second bevel gear 30 also has a central axial hole (not shown) which is communicated with the aforesaid axially extending hole 28 of the outer container 26. The second bevel gear 30 has the same diameter and number of teeth as those of the first bevel gear 17.

The rotor 19 is provided with a counterweight or balancer 31 which is coupled thereto through a medium of a shaft 32 at a position in linear symmetry to the outer container 26 about the vertical axis Y—Y. The counterweight 31 counterbalances the outer container 26 turning around the vertical axis Y—Y as the rotor 19 is rotated.

In the outer container 26, is placed a cylindrical bag 33 of polycarbonate resin or the like material for containing a fluid to be processed. The bag 33 has its neck portion 33*a* directed towards the central axially extending hole 28 of the outer container shaft portion 26*a*. Besides polycarbonate resins, the bag 33 may be made of hard synthetic resins such as acrylic resin, styrene-acrylonitrile copolymer, polyethylene, polypropylene, etc. in the form of, for example, a bottle, or flexible synthetic resins such as soft polyvinyl chloride, nylon, ethylene-vinyl acetate copolymer, etc.

To the inside of the neck portion 33*a* of the bag 33, one end of the conduit 34 is fixed in a hermetically sealed state. The conduit 34 may be made of flexible materials such as silicone rubber, soft polyvinyl chloride and the like.

The conduit 34 passes through the central axially extending hole 28 of the outer container 26 along the horizontal axis X—X to extend into the chamber 21 of the rotor 19, where it is bent downwardly to be substantially aligned with the vertical axis Y—Y for its downward passage through the central axially extending hole 15 of the stationary supporting shaft 14, whence the conduit 34 passes through the hole 26 bored in the base plate 11 and then a hole 35 bored in the wall of the housing 10 to extend outside thereof.

Thus, the conduit 34 has at least a horizontal section 34*a* running along the horizontal axis X—X, a vertical section 34*b* along the vertical axis Y—Y, and a curved section 34*c* interposed between the foregoing two sections 34*a* and 34*b* and disposed within the chamber 21.

The enlarged portion 26*b* of the outer container 26 has, at a suitable position, an opening (not shown) through which the bag 33 is taken into and out of said container 26.

A bundle of a plurality of bonded tubes are passed through the conduit 34. In this embodiment, three tubes 37, 38 and 39 are passed through one conduit 34.

Figure 4:
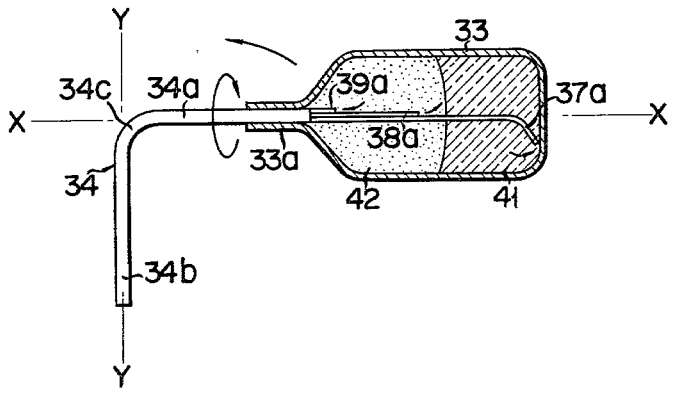
FIG. 4 is an enlarged partial view of a fluid container bag used in the centrifugal fluid processing device of FIG. 3, showing its state in which a conduit is connected thereto.

These tubes 37, 38 and 39 are horizontally inserted at one end into the bag 33 to different extents, as shown in FIGS. 3 and 4. One of these tubes, namely, the tube 37, extends to the deepest point of the bag 33 and has its end 37*a* inclined towards the corner of the bag 33. To describe in greater detail, the tube end 37*a* is inclined substantially in alignment with the direction in which a resultant centrifugal force acts on the fluid to be processed in the bag 33.

The end 38*a* of the second tube 38 extends into the bag 33 almost to a middle depth thereof. While, the third tube 39 has its end 39*a* extended into the bag 33 only to a small depth closer to the neck portion 33*a* of the bag 33. Thus, these three tubes 37, 38 and 39 have their ends 37*a*, 38*a* and 39*a* opened to the inside of the bag 33 at different positions along the horizontal axis X—X, respectively.

The other ends of the aforementioned three tubes (37 through 39) are connected to a lure connector, respectively, so that the tube 38 may be connected as an inlet tube to a feed circuit of the fluid, e.g. blood, to be processed, the tube 39 may be connected as a first outlet tube to a collecting bag of one separated fraction, e.g. plasmic fraction and the remaining tube 37 may be connected as a second outlet tube to a return circuit of another separated fraction, e.g. hematocytic fraction, respectively. Substantial portions of these external circuits and collecting bag are omitted from the drawings, but only their connecting portions are shown in chain lines in FIG. 3.

Before installing for use the bag 33 and conduit 34 connected thereto, a well-known cap having a gas passage is attached to each of the connectors 40, and the bag and conduit 34 are placed in a gas-sterilizing package bag to be sterilized therein with ethylene oxide gas.

Hereinafter, a manner in which blood is continuously separated into an erythrocytic fraction and plasmic fraction by using the preferred embodiment of the device according to the present invention shown in FIG. 3 will be described in detail. In this example, however, it is assumed that the plasmic fraction contains thrombocytes and leukocytes.

First, the bag 33 and conduit 34 are taken out of the gas-sterilizing package bag (not shown), and the bag 33 is installed in the outer container 26 and the conduit 34 is passed through the inside of the device to the outside thereof, as shown in FIG. 3.

Then, the inlet tube 38 is connected to a blood feed circuit (not shown) through its associated connector 40. While, the first outlet tube 39 is connected through its associated connector 40 to a plasmic fraction collecting bag (not shown), and the second outlet tube 37 is connected to a hematocytic fraction return circuit (not shown) through its associated connector 40. In this setup, the blood flowing in the inlet tube 38 along the conduit 34 first rises through the vertical section **34*b* in the direction of arrow A to the curved section 34*c*, whence it runs through the horizontal section 34*a* in the direction of arrow B to be fed into the bag 33**.

Before the blood is fed into the device in the aforementioned manner, the motor 25 is turned on, and the rotor 19 starts to rotate in the direction of arrow C (shown in FIG. 3), namely, clockwise as viewed in the direction in which the blood is fed through the vertical section **34*b* of the conduit 34**.

Then, the outer container 26 also revolves around the vertical axis Y—Y as the rotor 19 is rotated. Simultaneously with this revolution, the outer container 26 is rotated around the horizontal axis X—X, because the second bevel gear 30 coupled thereto is constantly engaged with the first bevel gear 17 fixed to the upper end of the stationary supporting shaft 14 which rotatably supports the rotor 19. It is to be noted here that the outer container 26 is rotated in the cunterclockwise direction shown by arrow D as viewed in the direction in which the blood flows through the horizontal section **34*a* of the conduit 34, namely, the direction of linear arrow B shown in FIG. 3**.

That is to say, the rotor 19 and the outer container 26 rotate towards the opposite directions to each other as viewed in the direction in which the blood is fed or flows through the conduit 34. To describe in greater detail, the rotor 19 is rotated about the vertical axis Y—Y in a given direction (as indicated by an arrow C) as viewed from the direction in which the fluid flows through conduit 34 at the vertical section **34*b* thereof. Said given direction is opposite to the direction (as indicated by an arrow D) in which the outer container 26 is rotated about the horizontal axis X—X as viewed from the direction in which the fluid flows through the conduit 34 at the horizontal section 34*a* thereof. This is one of advantageous features characterizing the present invention. Also, since the second bevel gear 30 has the same diameter and number of teeth as those of the first bevel gear 18, the speed ratio of the first bevel gear 17 versus second bevel gear 30** is substantially 1:1.

In the rotational relationship between the rotor 19 and the outer container 26 set up as mentioned above, the conduit 34, especially its curved section **34*c*, is not subjected to a complete twisting during the course of their rotation. Also in this course, the bag 33 and the horizontal section 34*a* of the conduit 34 are rotated along with the outer container 26 as it revolves about the vertical axis Y—Y, but the vertical section 34*b* and that section of the conduit 34** extending therefrom to the external end do not undergo a rotational motion.

The blood, after being made anticoagulant with ACD (Acid-citrate-dextrose) solution, is fed into the bag 33 at a rate of 30 ml/minute, for example. On the blood thus fed into the bag 33, is exerted a resultant centrifugal force, namely a vector sum of a centrifugal force produced in a horizontal plane by the revolution of the outer container 26 around the vertical axis Y—Y and a centrifugal force produced in a vertical plane by its rotation around the horizontal axis X—X. As a result of this action of the resultant force on the blood, it is separated into an erythrocytic fraction 41 gathered in the deepest or bottom zone of the bag 33 and a plasmic fraction 42 in the shallower or upper zone close to the neck portion **33*a* of the bag 33, as shown in FIG. 4. Also, the resultant force acts in such a direction that the erythrocytic fraction 41 is urged somewhat towards the inner peripheral side wall in the bottom zone of the bag 33 to be gathered there and the plasmic fraction towards the outer periphery in the shallower zone close to the neck portion 33*a* to be gathered there. Also, as shown in FIG. 4, the boundary surface between the thus separated fractions 41 and 42 has a small curvature. The erythrocytic fraction 41 flows into the outlet tube 37 from its bent end 37*a* to be transported to the hematocytic fraction return circuit. While, the plasmic fraction 42 flows into the outlet tube 39 from its end 39*a*** to be collected by the plasmic fraction collecting bag.

As described hereinabove, since the blood fed in the bag 33 is separated by a resultant centrifugal force acting thereon, the radius of gyration of the outer container 26, namely, the distance from the vertical axis to the same, can be made smaller and, thus, the entire device can be compact in size. Also, according to the present invention, the separated fractions can be taken out of the processing device while continuously feeding the blood into it, by passing a plurality of tubes through the conduit 34. Thus, a larger amount of blood can be processed within a shorter time as compared with the batch processing or intermittent processing according to the prior art. Especially, in the batch processing, the batch is limited by the size of a processing container used in specific devices. However, the continuous processing as according to the present invention is free from such a limitation.

Further, according to the present invention, the conduit can be remarkably shortened because it is led to the processing bag through the inside of the rotor. Consequently, the quantity of the blood remaining in the conduit at the end of the processing can be decreased, the energy required to rotate the conduit can be reduced, and the processing device itself can be made further smaller.

Furthermore, the centrifugal fluid processing device according to the present invention is free from bacterial contamination and inclusion of abrasion particulates into the bag contents because no rotary seal is used therein. Also, since such an expensive rotary seal is eliminated, it is possible to use a bag that can be fabricated at a lower cost.

Figure 1:
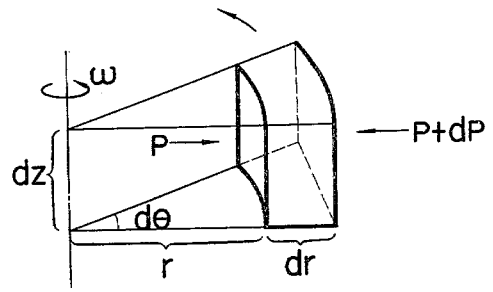
FIG. 1 is a typical centrifugal-force pressure equilibrium diagram presented for a better understanding of the basic principle of the fluid centrifugalization according to the present invention.
Figure 2A:
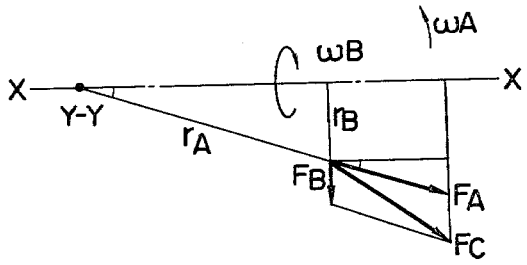
FIGS. 2*a* and 2*b* are diagrams illustrating directions of centrifugal forces acting on a fluid to be processed by the device according to the present invention.
Figure 2B:
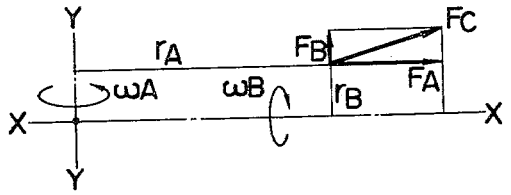

Hereinafter, the second preferred embodiment of the centrifugal fluid processing device according to the present invention will be described with reference to FIG. 5, wherein parts and components similar or corresponding to those of the first preferred embodiment are shown by numerals equal to the corresponding reference numerals in FIG. 1 plus 100. Since these corresponding parts have substantially the same constructions and functions as those in the first embodiment, they are omitted from the following description.

Figure 5:
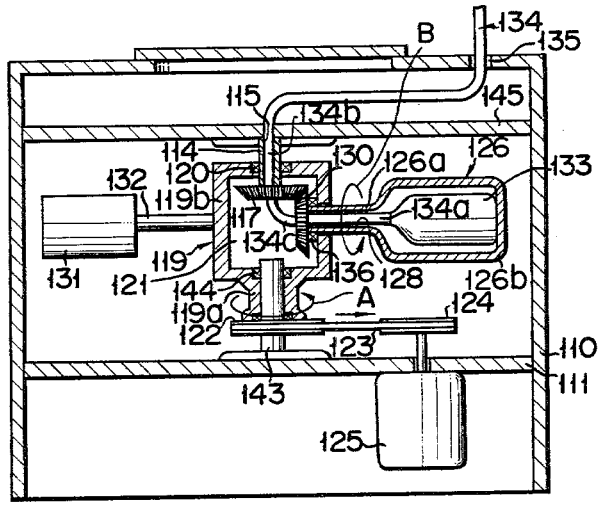
FIGS. 5 and 6 are longitudinal sections of the second and the third preferred embodiments of the centrifugal fluid processing device according to the present invention, respectively.

Referring now to FIG. 5, a housing 110 of the fluid processing device contains a base plate 111, on which a solid supporting shaft 143 is mounted to hold a rotor 119 by means of a bearing 144. The rotor 119 is driven to be rotated in the direction of arrow A by an electric motor 125 through a V-belt 123 stretched between a pulley 122 fixed to a shaft portion 119*a* of the rotor 119 and another pulley 124 fixed to the shaft of the electric motor 125.

Above an enlarged portion 119*b* of the rotor 119, there is provided an upper base plate 145, on which a second supporting shaft 114 is mounted to extend in line with the vertical axis of the solid supporting shaft 143 and support the rotor 119 by means of a bearing 120. The second supporting shaft 114 contains a central axially extending hole 115 for passing a conduit. A first bevel gear 117 is fixed to the lower end of this cylindrical supporting shaft 114 disposed in a chamber 121 defined by the rotor 119. The bevel gear 117 also contains a central axial hole (not shown) communicated with the aforesaid conduit hole 115.

On the side wall of the rotor 119, an outer container 126 is supported through a bearing 136 freely rotatably about its horizontal axis. Fixed to the innermost end of a shaft portion 126*a* of the outer container 126 disposed in the chamber 121 is a second bevel gear 130 engaged with the first bevel gear 117 and having the same diameter and number of teeth as those of the first bevel gear 117. This second bevel gear also contains a central axial hole (not shown) communicated with a central axially extending conduit hole 128 of the shaft portion 126*a*. Thus, as the rotor 119 turns in the direction of arrow A, the outer container 126 is also rotated in the direction of arrow B at the same speed as that of the rotor 119.

Installed in a processing chamber defined by an enlarged portion 126*b* of the outer container 126 is a bag or bottle 133, which is connected to one end of a conduit 134 having a horizontal section 134*a* disposed in the horizontally and axially extending hole 128, a vertical section 134*b* disposed in the vertically and axially extending hole 115, and a curved section 134*c* interposed between the foregoing two sections 134*a* and 134*b* and disposed within the chamber 121. The conduit 134 extends out of the housing 110 through a hole 135 bored in the ceiling wall of the housing 110.

Although not shown in FIG. 5, a plurality of tubes are passed through the conduit 134.

Further, a balance weight 131 is coupled to the rotor 119 through a shaft 132 in linear symmetry to the outer container 126 about the vertical axis of the rotor 119.

Also in this arrangement, the rotor 119 and outer container 126 rotate in the opposite directions each other as viewed in the direction in which the fluid is fed through the conduit 134 from its upper or external end to the bag 133. Thus, the conduit 134 is not subjected to complete twisting, when the horizontal section 134*a* thereof is rotated about its axis while revolving around the vertical axis of the rotor 119.

The second preferred embodiment of the present invention described herein above has substantially the same effects of centrifugalization as those obtained in the first preferred embodiment described previously.

Figure 6:
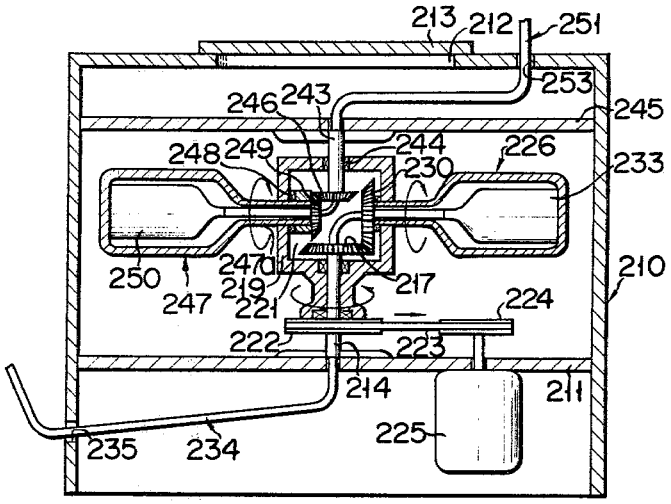

Hereinafter, the third preferred embodiment of the centrifugal fluid processing device according to the present invention will be described with reference to FIG. 6. The third preferred embodiment uses the arrangement of the first embodiment as it is along with a group of additional parts and components. In FIG. 6, parts and components corresponding to those used in the first embodiment are shown by numerals equal to the corresponding reference numerals in FIG. 1 plus 200, and they are omitted from the following description which is presented only for the additional parts and components.

Referring now to FIG. 6 showing the third preferred embodiment of the present invention, a cylindrical supporting shaft 243 is fixed onto a second base plate 245 in alignment with the vertical axis of the cylindrical supporting shaft 214 disposed below. The supporting shaft 243 supports the rotor 219 by means of a bearing 244. A bevel gear 246 is fixed to the lower end of the supporting shaft 243, namely, its free end disposed in the chamber 221 defined by the rotor 219.

On the side wall of the rotor 219, a second outer container 247 is supported by means of a bearing 248 to rotate freely around its horizontal axis and in a symmetrical relationship to the outer container 226 with respect to the vertical axis of the rotor 219. Fixed to that end of a shaft portion 247*a* of the second outer container 247 extending in the rotor chamber 221 is a second bevel gear 249 engaged with the afore-said bevel gear 246. Although these bevel gears 246 and 249 are somewhat smaller in diameter than the first set of bevel gears 217 and 230 due to a space limitation in the rotor chamber 221, they are identical to each other in diameter and number of teeth.

A conduit 251 having its one end connected to a bag 250 installed in the second outer container 247 is led through a horizontally and axially extending hole in the shaft section 247*a* of the outer container 247 and an axial hole (not shown) of the rotatable bevel gear 249 to the rotor chamber 221, where the conduit 243 is bent upwardly to be led into an axial hole (not shown) of the stationary bevel gear 246, whence it passes through a vertically and axially extending hole (not shown) in the cylindrical shaft 243 to finally extend outside upwardly through a hole 253 bored in the ceiling plate of the housing 210.

As viewed from the directions in which the fluid flows through the conduits 234 and 251, the rotor 219 is rotated about the vertical axis thereof in a direction opposite to those in which the corresponding containers 226 and 247 are rotated about the horizontal axes of them. The rotor 219 and two outer containers 226 and 247 are rotated all at the same speed. Further, in this arrangement, since the outer containers 226 and 247 are symmetrically disposed with respect to the vertical axis of the rotor 219 to be balanced each other when they revolve around this vertical axis, it is not necessary to provide a balance weight otherwise.

In addition to the useful effects characterizing the first embodiment, the third preferred embodiment described herein-above is characterized in that it can subject two fluids having different sources to the centrifugalization simultaneously, because two conduits are used therein. Also, for example, the centrifugal fluid processing device of the third preferred embodiment may be used to wash a separated erythrocytic fraction in such a manner that the erythrocytic fraction is mixed with a physiological salt solution in one processing bag and, then, the resultant mixture solution is transferred to the other processing bag to be centrifugalized therein. In this manner, a washed erythrocytic fraction can be taken out of said other processing bag. In this case, the plasmic fraction is sent through the conduit to its return circuit.

To cite another example, the third preferred embodiment of the present invention may be used to gather a thrombocytic fraction in such a manner that a high-thrombocyte content plasmic fraction separated in one processing bag is transferred to the other processing bag to be further separated into the thrombocytic fraction and a low-thrombocyte content plasmic fraction. In this case, if the resultant centrifugal force is set to such a level that sufficiently satisfies conditions required for the separation of the plasmic fraction and erythrocytic fraction, the high-thrombocyte content plasmic fraction is transferred to said other processing bag at a rate about half the feed rate of the blood. Thus, since the process of separating the thrombocytic fraction is allowed to continue for a length of time about twice that for which the process of separating the erythrocytic fraction is allowed to continue, a centrifugal force is exerted on the thrombocytic fraction for a sufficient time for more complete separation.

Figure 7:
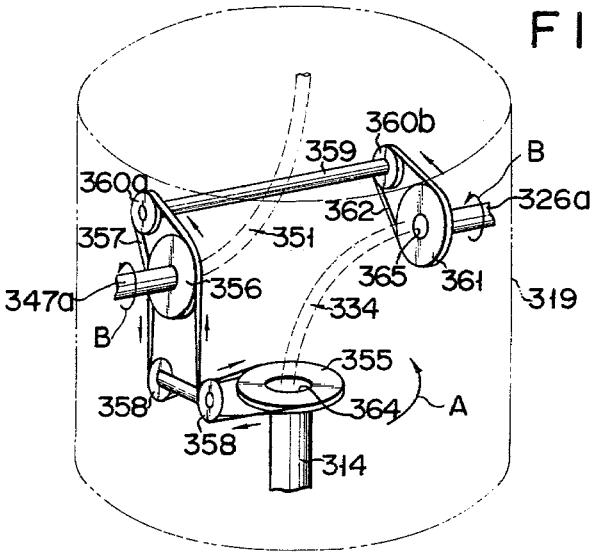
FIG. 7 is an oblique view of a pulley-belt drive system that may be used in place of a rotor driving system used in the preferred device shown in FIG. 6.

FIG. 7 shows a modified form of power transmission means usable in place of the transmission mechanism of the third preferred embodiment shown in FIG. 6 composed of two sets of paired bevel gears (217, 230; 246, 248). That is to say, this modified form of transmission adopts a pulley-belt mechanism instead of a bevel gear mechanism.

In FIG. 7, parts corresponding to those of the third preferred embodiment shown in FIG. 6 are indicated by numerals equal to the corresponding reference numerals shown in FIG. 6 plus 300.

A guide pulley 355 is fixed to the upper end of the stationary cylindrical supporting shaft 314 supporting the rotor 319 freely rotatably around its vertical axis, and a pair of outer containers each having shaft portions 326*a* and 347*a* are supported on the rotor 319 one on each side thereof. Another pulley 356 is fixed to the shaft portion 347*a* of one outer container, and is linked to the guide pulley 355 via an endless V-belt and paired direction-turning guide pulley 358. A pair of intermediate transmission pulleys 360*a* and 360*b* are fixed, one at each end, to a horizontal supporting shaft 359 supported by the rotor 319 inside thereof. The aforesaid V-belt 357 is suspended on one of these intermediate transmission pulleys, namely, pulley 360*a*. While, another endless V-belt is stretched across a pulley 361 fixed to the shaft portion 326*a* of the other outer container and the other intermediate transmission pulley 360*b*. One conduits 351 (shown by broken lines) coming in from above is bent in the rotor 319 to be passed through a axially extending central hole of the shaft portion 347*a*. The pulley 356 has an central axial hole (invisible in FIG. 7) for passing the conduit 351. The other conduit 334 is led from the underside of the rotor 319 through the stationary cylindrical supporting shaft 314 and a central axial hole 364 of the pulley 355 to the inside of the rotor 319, where it is bent to be passed through a central axial hole 365 of the pulley 361 and then the axially extending central hole of the shaft portion 326*a*.

Accordingly, in this arrangement described hereinabove, if the rotor 319 is driven by a drive means (not shown) similar to one shown in FIG. 6 to rotate in the direction of arrow A, the pulley-belt mechanism is also driven to the direction indicated by linear arrows to rotate the shaft portions 326*a* and 347*a* of the outer containers in the direction of arrow B, which is the same direction as in the preferred embodiment of FIG. 6. Also, since the pulleys 356 and 361 are identical to the guide pulley 355 in their diameters, the two shaft portions 326*a* and 347*a* or both outer containers rotate at the same speed as that of the rotor 319. Thus, in this modified example also, the conduits 334 and 351 are not subjected to complete twisting when they are rotated and revolved.

Figure 8:
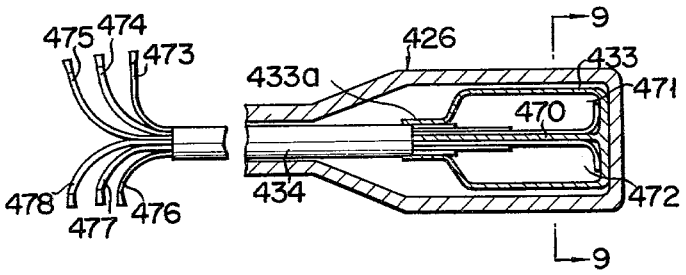
FIG. 8 is a partial longitudinal section showing a modified construction of the fluid container bag shown in FIG. 4.
Figure 9:
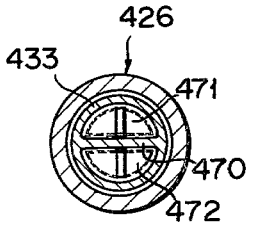
FIG. 9 is a cross section taken on the line 9—9 of FIG. 8.

FIGS. 8 and 9 show a modified form of fluid processing bag.

In this modified example, the bag 33 placed in the outer container 426 has the inside thereof divided into two processing chambers 471 and 472 by a longitudinal partition wall (horizontally disposed as seen in FIGS. 8 and 9). One end of the conduit 434 is fixed into the neck portion 433*a* of the bag 433 in a hermetically sealed state. A bundle of six tubes 473 through 478 are passed through the conduit 434. This tube bundle is divided into two groups of three tubes each, and tubes 473 through 475 in one group are inserted into one processing chamber 471 to different extents. Likewise remaining there tubes 476 through 478 of the other group are inserted into the other processing chamber 472 to different extents.

By arranging the fluid processing bag in the aforementioned manner, a centrifugal fluid processing device having only one outer container can process simultaneously two different fluids as in the case of the third preferred embodiment of the present invention shown in FIG. 6.

Thus, as described hereinbefore, in actually designing the centrifugal fluid processing device according to the present invention, it may adopt a bag composed of a plurality of chambers, or it may be provided with a plurality of outer containers, as desired, depending on its specific applications.

Further, when using a single-chamber bag, four or more tubes may be passed through the conduit by using some of them as inlet tubes and the rest as outlet tubes.

Furthermore, the fluid processing flexible bag used for the device according to the present invention is brought into close contact with the inner peripheral wall surface of the outer container by the action of the centrifugal force so as to maintain a certain expanded shape when the device is in operation. Thus, it is not necessary to fill the bag with sterilized air, physiological salt solution or the like prior to feeding therein a fluid to be processed.

However, the fluid processing bag used for the device according to the present invention need not be formed of flexible and extendible material. But, as need arises, it is possible to use a rigid bag or bottle which is made of hard material with a prescribed shape.

The device according to the present invention may be arranged in such a manner, depending on specific fluids to be processed, that one end of the conduit is connected directly to a container, corresponding to the aforementioned outer containers but having a closed construction, to centrifugalize the fluid therein without using the fluid processing bag. Generally, a sterilized fluid processing bag is required when centrifugalizing blood or the like fluids associated with the human body, but such a bag is seldom required for processing other fluids.

A modified arrangement in which a fluid to be processed is directly received in a container without using a bag to be centrifugally separated can be easily applied to any of the aforesaid embodiments by those skilled in the art.

What is claimed is:

1. A centrifugal fluid processing device comprising:

a stationary base;

a vertically extended support mounted on said stationary base and having a vertical axis;

a rotor rotatably supported on said vertically extended support and being rotatable about the vertical axis of said vertically extended support;

a rotor drive assembly coupled to said rotor;

fluid processing container means rotatable along with said rotor about said vertical axis and being further rotatable independently of said rotor about an axis of rotation disposed radially or perpendicular to said vertical axis;

a flexible communication conduit which has one end thereof extended into said fluid processing container means and the other end thereof led to the outside of the device and through which a fluid to be processed is fed into said fluid processing container means, said flexible fluid communication conduit comprising at least a radially extending section which extends along said radially disposed axis of rotation and a vertically extending section which extends along said vertical axis of said vertically extended support; and means to drive said fluid processing container means for rotating the same about said radially disposed axis of rotation.

2. A centrifugal fluid processing device comprising:

a stationary base;

a supporting shaft rigidly fixed to said stationary base and extended vertically therefrom, said supporting shaft having a vertical axis;

a rotor rotatably supported on said supporting shaft and being rotatable about the vertical axis of said supporting shaft, said rotor defining therein a chamber;

a rotor drive assembly coupled to said rotor;

fluid processing container means rotatable along with said rotor about said vertical axis and being further rotatable independently of said rotor about an axis of rotation disposed radially or perpendicular to said vertical axis;

a flexible communication conduit which has one end thereof extended into said fluid processing container means and the other end thereof led to the outside of the device and through which a fluid is fed into saif fluid processing container means, said flexible communication conduit comprising at least a radially extending section which extends along said radially disposed axis of rotation, a vertically extending section which extends along said vertical axis of said supporting shaft and a curved section interposed between the foregoing two sections and disposed in said chamber defined by said rotor; and driving power transmission means coupling said fluid processing container means to said rotor driving assembly for rotating said fluid processing container means about said radially disposed axis of rotation at a speed ratio of 1:1 versus the rotation of said rotor about said vertical axis and in a direction opposite to that of said rotor rotation as viewed in the direction of which said fluid flows through said conduit.

3. A centrifugal fluid processing device comprising:

a stationary base;

a supporting shaft rigidly fixed to said stationary base and extended vertically therefrom, said supporting shaft having a vertical axis;

a rotor rotatably supported on said supporting shaft and being rotatable about the vertical axis of said supporting shaft, said rotor defining therein a chamber;

a rotor drive assembly coupled to said rotor;

a container supported on said rotor and being rotatable along with said rotor about said vertical axis and being further rotatable independently of said rotor about an axis of rotation disposed radially or perpendicular to said vertical axis;

at least one fluid processing bag located in said container;

a flexible communication conduit which has one end thereof extended into said fluid processing bag and the other end thereof led to the outside of the device and through which a fluid is fed into said fluid processing bag, said flexible communication conduit comprising at least a radially extending section which extends along said radially disposed axis of rotation, a vertically extending section which extends along said vertical axis of said supporting shaft and a curved section interposed between the foregoing two sections and disposed in said chamber defined by said rotor; and driving power transmission means coupling said container to said rotor driving assembly for rotating said container about said radially disposed axis of rotation at a speed ratio of 1:1 versus the rotation of said rotor about said vertical axis and in a direction opposite to that of said rotor rotation as viewed in the direction in which said fluid flows through said conduit.

4. The centrifugal fluid processing device according to claim 2 or 3, wherein said supporting shaft has a vertically extending central hole along said vertical axis, and said vertically extending section of said flexible communication conduit passes through said central hole of said supporting shaft.

5. The centrifugal fluid processing device according to claim 2 or 3, wherein said rotor driving assembly comprises an electric motor mounted on said stationary base and a pulley-belt mechanism coupling said electric motor to said rotor.

6. The centrifugal fluid processing device according to claim 2 or 3, wherein said driving power transmission means comprises a bevel gear mechanism.

7. The centrifugal fluid processing device according to claim 2, wherein said flexible communication conduit contains therein at least three flexible tubes, one end of each of said tubes being inserted into said fluid processing container means to different extents along said radially disposed axis, and one of said at least three tubes extending to the deepest position has the foremost end portion thereof inclined against said radially disposed axis.

8. The centrifugal fluid processing device according to claim 2 further comprising balance weight means for balancing the inertia force of said fluid processing container means, said balance weight means being supported on said rotor at a position in linear symmetry to said fluid processing container means with respect to the axis of rotation of said rotor.

9. The centrifugal fluid processing device according to claim 3, wherein said container has an axially extending central hole along said radially disposed axis of rotation, and said radially extending section of said flexible communication conduit passes through said axially extending central hole of said container.

10. The centrifugal fluid processing device according to claim 3 further comprising:

another container mounted on said rotor at a position in linear symmetry to said first-mentioned container with respect to the axis of rotation of said rotor;

another supporting shaft disposed at a position in linear symmetry to said first-mentioned supporting shaft with respect to said radially disposed axis of rotation and rigidly fixed to said stationary base so as to further support said rotor;

another fluid processing bag located in said another container;

another flexible fluid communication conduit having one end thereof connected to said another bag and the other end thereof led to the outside of the device, said another flexible fluid communication conduit comprising a vertically extending section which extends along said vertical axis, a radially extending section which extends along said radially disposed axis and a curved section interposed between the foregoing two sections and disposed in said chamber defined by said rotor; and another driving power transmission means for rotating said another container about said radially disposed axis in the same manner as said first container is rotated about said radially disposed axis.

11. The centrifugal fluid processing device according to claim 10, wherein said rotor driving assembly, said first mentioned and said another driving power transmission means comprise a rotational driving source, and one pulley-belt mechanism which couples said rotational driving source to said rotor, said first mentioned container and said another container.

12. The centrifugal fluid processing device according to claim 3, wherein said fluid processing bag has therein a partition wall disposed along said radially disposed axis to define two chambers in said fluid processing bag, and said flexible fluid communication conduit contains a number of flexible tubes, some of said flexible tubes having ends thereof extended into one of said two chambers defined by said partition wall and the rest having ends thereof extended into the other of said two chambers.

13. A centrifugal fluid processing device comprising:

a stationary base;

a rotor supported on said stationary base and being rotatable about one axis;

a fluid processing container rotatable along with said rotor about said one axis and being further rotatable independently of said rotor about another axis disposed radially or perpendicular to said one axis;

a fluid communication conduit having one end thereof connected to said fluid processing container and the other end thereof extended to the outside of the device, said fluid communication conduit including a first section, a second section and a third section interposed between said first and second sections;

first guide means for guiding said first section of said fluid communication conduit in the direction of said one axis;

second guide means for guiding said second section of said fluid communication conduit in the direction of said another axis to thereby bend said third section in said rotor; and rotational driving means for driving said rotor to rotate together with said fluid processing container about said one axis and to rotate said fluid processing container about said another axis such that said fluid communication conduit, especially said third section thereof, is not subjected to complete twisting during the course of said rotation of said rotor and said fluid processing container revolving about said rotor and such that said fluid processing container rotates and revolves substantially at the same speed as the speed of rotation of said rotor bout said first axis.

14. A centrifugal fluid separator comprising:

a stationary base;

a supporting shaft fixed to said stationary base and extending vertically therefrom, said supporting shaft having a vertical axis and further having therein a central axially extending hole;

a rotor having therein a chamber and being rotatably supported on said supporting shaft so as to be rotatable about the vertical axis of said supporting shaft, an upper end of said supporting shaft extending into said rotor chamber;

a stationary bevel gear disposed in a horizontal plane and fixed onto said upper end of said supporting shaft, said stationary bevel gear having therein a central axial hole communicating with said central axially extending hole of said supporting shaft;

a container supported on said rotor and being rotatable about the longitudinal or horizontal axis thereof and including a shaft portion defining therein a central axially extending hole along said horizontal axis and an enlarged portion defining therein a fluid processing chamber, said shaft portion of said container having one end thereof extended into said rotor chamber;

a movable bevel gear fixed to said one end of said shaft portion of said container and engaged with said stationary bevel gear, said movable bevel gear having therein a central axial hole communicating with said central axially extending hole of said shaft portion;

a bag located in said fluid processing chamber of said container;

a fluid communication conduit having one end thereof connected to said bag and the other end thereof extended to the outside of the device, said fluid communication conduit passing through said central axially extending hole of said shaft portion of said container to said rotor chamber, where said fluid communication conduit is bent vertically to be led into and passed through said central vertically extending hole of said supporting shaft; and means for driving said rotor to rotate said rotor about said vertical axis, to thereby cause said container to revolve about said vertical axis and to rotate about said horizontal axis without subjecting said fluid communication conduit to complete twisting.

15. A process for centrifugalizing liquids which comprise components having different specific gravities, comprising:

feeding a liquid to be processed into at least one inlet tube from one end thereof, said at least one inlet tube being selected out of a plurality of tubes passed through one fluid communication conduit;

flowing said liquid first in a vertical direction without substantially applying centrifugal forces thereon and, then, in a horizontal direction;

applying onto said fed liquid flowing in said horizontal direction a horizontal centrifugal force in the direction in which said liquid flows and a vertical centrifugal force in said vertical direction;

feeding said liquid into a processing chamber from the other end of said at least one inlet tube by further applying thereon a resultant centrifugal force of said vertical and horizontal centrifugal forces;

separating said liquid in said processing chamber by the action of said resultant centrifugal force; and forcing the separated liquid fractions into corresponding outlet tubes opened to said processing chamber, respectively.

16. The process according to claim 15, wherein said step of applying said centrifugal forces on to said liquid comprises rotating said processing chamber about a vertical axis which is substantially in alignment with said vertical direction in which said liquid flows through said at least one inlet tube; and simultaneously rotating said processing chamber about a horizontal axis so that said resultant centrifugal force is produced.

* * * * *